United States Patent [19]

Horiuchi et al.

[11] Patent Number: 4,580,781

[45] Date of Patent: Apr. 8, 1986

[54] PRESSURELESS TENNIS BALL

[75] Inventors: Kuniyasu Horiuchi; Masao Nakamura, both of Kobe, Japan

[73] Assignee: Sumitomo Rubber Industries, Ltd., Kobe, Japan

[21] Appl. No.: 608,679

[22] Filed: May 10, 1984

[30] Foreign Application Priority Data

Nov. 14, 1983 [JP] Japan ..... 58-214664

[51] Int. Cl.[4] ..... A63B 39/06; C08L 7/00; C08L 9/00

[52] U.S. Cl. ..... 273/61 C; 260/998.14; 524/908; 525/236; 525/237

[58] Field of Search ..... 273/61 R; 524/908; 260/998.14; 525/236, 237; 273/61 C

[56] References Cited

U.S. PATENT DOCUMENTS 3,423,337 1/1969 Sugiura et al. ..... 260/94.3
3,935,180 1/1976 Sugiura et al. ..... 260/94.2
4,145,045 3/1979 Pocklington ..... 273/61 C
4,306,719 12/1981 Haines et al. ..... 260/998.14
4,468,496 8/1984 Takeuchi et al. ..... 525/236

OTHER PUBLICATIONS

Vinyl and Diene Monomers, Part 2, pp. 925–936 (1971).
Science and Technology of Rubber, pp. 61–65 (1978).

*Primary Examiner*—Allan M. Lieberman
*Attorney, Agent, or Firm*—Armstrong, Nikaido, Marmelstein & Kubovcik

[57] ABSTRACT

Pressureless tennis balls which comply with regulations of the International Tennis Federation and produce a satisfactory feel of striking retained over an extended period of play, and which comprises a hollow spherical core made from a rubber composition the rubber component of which contains 5 to 50% by weight of a particular modified polybutadiene containing 5 to 30% by weight of syndiotactic-1,2-polybutadiene and at least 40% by weight of cis-1,4-polybutadiene.

1 Claim, No Drawings

PRESSURELESS TENNIS BALL

BACKGROUND OF THE INVENTION

The present invention relates to improvements in pressureless tennis balls, and more particularly to pressureless tennis balls having excellent properties and feel of striking comparable to those of pressurized tennis balls.

Tennis balls are classified into pressurized tennis balls and pressureless tennis balls. The pressurized tennis balls generally consist of an inner hollow core (core ball) made of a rubber or a rubber-like elastomer containing air or a gas at a pressure about 0.6 to 0.9 kg./cm.$^2$ higher than the atmospheric pressure and a textile or felt covering. The pressureless tennis balls generally consist of an inner hollow core containing air at atmospheric pressure and a textile or felt covering.

The pressurized tennis balls have the disadvantage that the gas or air of super-atmospheric pressure contained in the core gradually diffuses out through the core wall owing to a pressure difference between the inside and outside of the core and the internal pressure decreases in several months. Consequently, the rebound properties, namely the flight performance, of the ball is reduced, and the tennis balls are no longer satisfactorily used. It is accordingly necessary for the pressurized tennis balls to be used within a certain specified time after manufacture or to be kept in pressurized containers prior to use for preventing or decreasing the lowering of the internal pressure. However, such a care is inconvenient and expensive.

In order to eliminate these disadvantages, various pressureless tennis balls have been proposed. For instance, U.S. Pat. No. 2,896,949 discloses a pressureless tennis ball made from a core composition containing rubber and 10 to 45 parts by weight of a high styrene-butadiene copolymer per 90 to 55 parts by weight of rubber. Japanese Unexamined Patent Publication (Tokkyo Kokai) No. 96171/1980 discloses a pressureless tennis ball having a core made from a rubber composition containing either a copolymer of ethylene and propylene or a terpolymer of ethylene, propylene and a non-conjugated diene monomer in an amount of at most 60% by weight based on the total weight of the whole polymers. Japanese Unexamined Patent Publication No. 34934/1979 discloses a pressureless tennis ball made from a core composition containing as a polymer component 10 to 30% by weight of an ionomer resin, 30 to 70% by weight of natural rubber and 50 to 80% by weight of cis-1,4-polybutadiene. It is also proposed to incorporate in a core composition for a pressureless tennis ball 20 to 50% by weight of wood flour as a reinforcing filler based on a rubber, as known from British Pat. No. 1,108,556.

However, any pressureless tennis balls available at the present time are not used in high class tennis tournaments, since the pressureless tennis balls do not give a satisfactory feeling at the time of striking by a racket or the softer ones are bad in flight and do not give a feeling of striking like pressurized tennis balls, and moreover the lowering of compression is marked owing to repeated forceful striking in the course of game or playing.

It is an object of the present invention to provide a pressureless tennis ball which has none of the drawbacks of conventional pressureless tennis balls and has characterisitcs comparable to those of pressurized tennis balls.

This and other objects of the present invention will become apparent from the description hereinafter.

SUMMARY OF THE INVENTION

It has now been found that pressureless tennis balls having characteristics and feeling of striking comparable to those of pressurized tennis balls are obtained by preparing a tennis ball core from a rubber composition containing as a rubber component a combination of a polymer and 5 to 50% by weight of a specific modified polybutadiene rubber containing 5 to 30% by weight of a syndiotactic-1,2-polybutadiene component and at least 40% by weight of a cis-1,4-polybutadiene component.

In accordance with the present invention, there is provided a pressureless tennis ball comprising a hollow spherical core the internal pressure of which is substantially equal to atmospheric pressure and a covering for covering said core, said core being made from a rubber composition comprising 5 to 50% by weight of, based on the whole polymers, a modified polybutadiene containing 5 to 30% by weight of a syndiotacitc-1,2-polybutadiene component and at least 40% by weight of a cis-1,4-polybutadiene component.

DETAILED DESCRIPTION

A particular modified polybutadiene (hereinafter referred to as "VCR") containing 5 to 30% by weight of a syndiotactic-1,2-polybutadiene component and at least 40% by weight of a cis-1,4-polybutadiene component is used in the present invention. VCR can be prepared, for instance, by conducting a cis-polymerization of butadiene and subsequently conducting a 1,2-syndiotacticpolymerization of butadiene in the same system. The product contains syndiotactic-1,2-polybutadiene and cis-1,4-polybutadiene, and may partly contain a 1,2-polybutadiene/cis-1,4-polybutadiene copolymer or trans-1,4-polybutadiene.

A combination of 5 to 50% by weight of VCR and 95 to 50% by weight of other rubbers or polymers is employed in the present invention as a polymer component of a core composition for preparing a spherical hollow core. Representative examples of other rubbers or polymers are, for instance, natural rubber, cis-1,4-polybutadiene, a styrene-butadiene rubber and a high styrene-butadiene copolymer. When the content of VCR in the polymer component is more than 50% by weight, the obtained tennis ball gives a hard feeling of striking and the rebound property is lowered. When the content of VCR is less than 5% by weight, the tennis ball becomes soft and no sufficient effect produced by the use of VCR is obtained, and when a large amount of a high styrene-butadiene copolymer or the like is incorporated in order to impart a hardness, the tennis ball gives a hard feeling of striking, thus no satisfactory tennis ball is obtained.

It is preferable that the content of syndiotactic-1,2-polybutadiene in VCR is from 5 to 30% by weight. When the content is higher than the above range, the rebound property is lowered. When the content is lower than the above range, the tennis ball becomes soft and the use of a large amount of a high styrene-butadiene copolymer or the like is required to impart a hardness, whereby the feeling of striking becomes hard and no satisfactory tennis ball is obtained. Also, it is preferable that the content of cis-1,4-polybutadiene in VCR is at least 40% by weight. When the content is lower than 40% by weight, the rebound property is lowered.

VCR used in the present invention is commercially available, for instance under the commercial names "UBEPOL-VCR 309" and "UBEPOL-VCR 412" made by Ube Industries, Ltd.

The rubber composition for preparing the tennis ball core is formulated by using the above-mentioned combination as a polymer component and usual rubber additives. Usually, the core composition is prepared by adding to 100 parts by weight of the polymer component, 3 to 10 parts by weight of zinc oxide, 5 to 40 parts by weight of a filler such as wood flour, carbon black, a magnesium-silica type mineral, calcium carbonate or clay, 2 to 5 parts by weight of sulfur and 1 to 5 parts by weight of a curing accerelator. The pressureless tennis balls of the present invention are obtained by producing a ball core from the rubber composition and covering the ball core with a felt or textile covering.

The preparation of the rubber composition, the production of the ball core from the composition and the production of the pressureless tennis ball from the ball core can be made by known techniques which have been usually adopted to the manufacturing of pressureless tennis balls. For instance, the rubber composition is prepared by homogeneously mixing ingredients by a suitable mixing means such as a roll mixer or a Banbury mixer. A ball core is produced from the composition, for instance, by compression-molding the composition in a mold to produce half-shells, placing a pair of the half-shells in a mold and compression-molding the shells in a mold to form a hollow sphere. At that time, a blowing agent as used in the manufacturing of pressurized tennis balls is not used, but only air of atmospheric pressure is included in the ball core. Also, introduction of a high pressure air or gas into the obtained ball core is not conducted. Therefore, the internal pressure of the obtained ball core is substantially equal to atmospheric pressure. The ball core is then made into tennis ball by applying a felt or textile covering such as a melton covering and further carrying out the compression molding in a mold.

The pressureless tennis balls of the present invention produce a satisfactory feel like pressurized tennis balls when struck by a racket, and the original feel of striking is maintained for a long period of time even if the balls are repeatedly struck by a racket. Also, the pressureless tennis balls of the invention have excellent properties comparable to those of pressurized tennis balls, particularly a high impact resilience. Thus, the pressureless tennis balls of the invention are sufficiently acceptable to the high class tennis tournaments.

The present invention is more specifically described and explained by means of the following Examples, in which all parts and % are by weight unless otherwise noted.

EXAMPLES 1 TO 4 AND COMPARATIVE EXAMPLES 1 AND 2

Rubber compositions were prepared according to the formulations shown in Table 1 by kneading a rubber and ingredients other than sulfur and an accelerator in a Banbury mixer, and then kneading the mixture with sulfur and the accelerator on rolls. The compositions were formed into sheets, and extruded by an extruder in the form of a rod. After cutting the rods into pieces suited for a mold for preparing half-shells, the pieces were placed in the molds and compression-molded at 160° C. for 2 minutes to produce half-shells. A pair of the half-shells were placed in a mold for preparing ball cores and compression-molded at 150° C. for 12 minutes to produce tennis ball cores. Pressureless tennis balls were produced by applying a melton covering to the ball cores and subjecting to compression molding at 150° C. for 20 minutes in a mold.

The results of measurement of physical properties and feeling of striking of the obtained pressureless tennis balls are shown in Table 2.

The forward compression, return compression and rebound shown in Table 2 were measured as follows:

Forward compression

The measurement was carried out with a Stevens machine.

A tennis ball was subsequently compressed about 2.54 cm. in three directions at right angles to each other. This procedure was repeated 3 times. That is to say, the ball was compressed 9 times total. After the above preliminary compression, the deformation was measured in 2 hours according to the following manner.

The ball was compressed with a load of 3.5 pounds (1.575 kg.) and the deformation was measured, and the ball was then compressed with a load of 18 pounds (8.165 kg.) and the deformation was measured. The forward compression is expressed by the difference between the deformation by a load of 3.5 pounds and the deformation by a load of 18 pounds.

Return compression

After measuring the deformation in the above forward compression test, the ball was compressed so that the deformation was 2.54 cm. Then the compression was reduced to a load of 18 pounds, and the deformation was measured.

Rebound

A tennis ball was dropped from a height of 254 cm. onto a concrete base, and the rebound of the ball was measured.

TABLE 1

| Ingredients (part) | Ex. 1 | Ex. 2 | Ex. 3 | Ex. 4 | Com. Ex. 4 | Com. Ex. 2 |
|---|---|---|---|---|---|---|
| Natural rubber | 82 | 75 | 65 | 55 | 10 | 100 |
| Cis-1,4-polybutadiene*1 | — | — | — | — | 50 | — |
| VCR*2 | 10 | 20 | 30 | 40 | — | — |
| EPDM*3 | — | — | — | — | 40 | — |
| High styrene resin*4 | 8 | 5 | 5 | 5 | — | 30 |
| Zinc oxide | 5 | 5 | 5 | 5 | 7 | 5 |
| Carbon black (HAF) | 5 | 3 | 3 | 3 | 10 | — |
| Wood flour | 20 | 20 | 20 | 20 | 12.5 | — |
| Kaolin clay | — | — | — | — | — | 20 |
| Stearic acid | 1 | 1 | 1 | 1 | 1 | 2 |
| Sulfur | 3.5 | 3.5 | 3.0 | 2.5 | 3.5 | 2.5 |
| Diphenylguanidine*5 | 2.0 | 2.0 | 2.0 | 2.0 | 1 | 1 |
| Dibenzothiazyl disulfide*5 | 1.5 | 1.5 | 1.5 | 1.5 | 2 | 2 |

*1JSR BR11 made by Japan Synthetic Rubber Co., Ltd.
*2UBEPOL-VCR412 made by Ube Industries, Ltd. containing 12% of syndiotactic-1,2-polybutadiene, 86% of cis-1,4-polybutadiene and 2% of trans-1,4-polybutadiene
*3Ethylene/propylene/non-conjugated diene terpolymer (ESPRENE 512F made by Sumitomo Chemical Co., Ltd.)
*4Copolymer of 85% of styrene and 15% of butadiene
*5Accelerator

TABLE 2

| | Weight (g.) | Forward compression (mm.) | Return compression (mm.) | Rebound (cm.) | Feeling |
|---|---|---|---|---|---|
| Ex. 1 | 57.5 | 6.3 | 9.8 | 143 | Feeling like pressure tennis ball, a little change by repeated striking |
| Ex. 2 | 57.5 | 6.1 | 9.6 | 144 | Feeling like pressure tennis ball, a little change by repeated striking |
| Ex. 3 | 57.5 | 6.1 | 9.5 | 144 | Feeling like pressure tennis ball, a little change by repeated striking |
| Ex. 4 | 57.5 | 6.0 | 9.5 | 144 | Feeling like pressure tennis ball, a little change by repeated striking |
| Com. Ex. 1 | 57.8 | 5.8 | 9.0 | 135 | Hard, large change by repeated striking |
| Com. Ex. 2 | 57.8 | 5.0 | 8.3 | 132 | Very hard |
| Regulation of ITF* | 56.7 to 58.5 | 5.6 to 7.4 | 8.9 to 10.8 | 135 to 147 | — |

*International Tennis Federation

As shown in Table 2, the tennis balls of Examples according to the present invention have a high rebound as compared with the tennis balls of Comparative Examples, and also have proper forward compression and return compression values. Also, the tennis balls of Examples do not produce a hard feel of striking, but have a similar feel of striking to that of pressurized tennis balls. Further, with respect to the change in feel of striking by repeated strokes, too, the tennis balls of Examples are very good. Thus, it would be understood that the pressureless tennis balls of the present invention have excellent characteristics acceptable sufficiently to the high class tennis tournaments.

In addition to the ingredients used in the Examples, other ingredients can be used in the Examples as set forth in the specification to obtain substantially the same results.

What we claim is:

1. A pressureless tennis ball comprising a hollow spherical core the internal pressure of which is substantially equal to atmospheric pressure and a covering for covering said core, said core being made from a rubber composition comprising (A) 5 to 50% by weight of, based on the whole polymers, a polybutadiene component containing 5 to 30% by weight of a syndiotactic-1,2-polybutadiene component and at least 40% by weight of a cis-1,4-polybutadiene component and prepared by a two stage polymerization of butadiene in which butadiene is polymerized first by a cis-polymerization and subsequently polymerized in the same system by a 1,2-syndiotactic-polymerization, and (B) 95 to 50% by weight of at least one polymer selected from the group consisting of natural rubber, cis-1,4-polybutadiene, styrene-butadiene rubber and a high styrene-butadiene copolymer.

* * * * *